United States Patent [19]

Floyd

[11] 4,415,284

[45] Nov. 15, 1983

[54] THERMAL DIE-CUTTING MACHINE FOR DIE-CUTTING LETTERS, NUMERALS AND OTHER CHARACTERS FROM PLASTIC TAPE

[75] Inventor: James N. Floyd, Lexington, Ky.

[73] Assignee: James W. Moss, Louisville, Ky.

[21] Appl. No.: 315,289

[22] Filed: Oct. 27, 1981

[51] Int. Cl.[3] ..... B41J 1/22

[52] U.S. Cl. ..... 400/134; 400/179; 425/385

[58] Field of Search ..... 425/385; 400/129, 130, 400/131, 132, 133, 134, 134.1, 134.2, 134.3, 134.4, 134.5, 134.6, 182, 183, 179

[56] References Cited

U.S. PATENT DOCUMENTS

| | | | |
|---|---|---|---|
| 1,300,342 | 4/1919 | Campbell | 400/134 |
| 3,227,258 | 1/1966 | Pannier et al. | 400/131 |
| 3,301,370 | 1/1967 | Miller | 400/134 |
| 3,768,619 | 10/1973 | Lewis . | |

*Primary Examiner*—James B. Lowe

[57] ABSTRACT

An improved machine for heating and die cutting plastic tape to form letters, numerals and other characters is disclosed which includes a rotatable disc-shaped print plate which defines a plurality of raised characters spaced in a circle on and around one broad surface thereof. The print plate includes a central hub, a thermally conductive backing plate attached to the hub but thermally isolated from the hub by thermally insulating washers disposed therebetween, and a thermally conductive print ring, containing the raised characters thereon, which is attached to the backing plate, and a heating ring including electrical resistance wire zig-zagging between a pair of sheets of electrically insulating rubber material, the heating ring being disposed between the backing plate and print ring. A print pedestal is disposed opposite the print ring and contains a movable plate upon which is mounted a rubber pad which is movable upon command against any selected one of the raised characters depending upon the rotational alignment of the print plate relative to the pedestal. A locking means, which may be an air cylinder operated plunger, is engageable with grooves located in a circle around and in the central hub to lock the print plate in precise alignment during each printing operation. A movable tape index plate is also disclosed which is coupled through a gear train to a pair of rollers which advances the plastic tape across the print pedestal pad as the plate advances toward one of several adjustable stop pins which are selectively alignable to interfere with the advancement of the tape index plate to limit such advance to any one of several precise distances.

16 Claims, 7 Drawing Figures

THERMAL DIE-CUTTING MACHINE FOR DIE-CUTTING LETTERS, NUMERALS AND OTHER CHARACTERS FROM PLASTIC TAPE

BACKGROUND OF THE INVENTION

This invention relates generally to a machine of the type used to heat and die cut letters, numerals or other characters and images from conventional vinyl plastic tape, such tape characteristically having an adhesive backing thereon whereby the characters die cut from the tape can be applied to surfaces of various kinds and descriptions such as automobile and truck bodies, warehouse shelving, cartons and containers, to name but a few.

Such machines generally speaking are well known and widely used at the present time. See for example the tape embossing machines disclosed in U.S. Pat. No. 3,904,012, issued to M. Friedel on Sept. 9, 1975, and U.S. Pat. No. 3,753,482, issued to M. Brown, et al. on Aug. 21, 1973. Other prior art patents which disclose various types of printing machines having some structure more or less pertinent to the present invention include U.S. Pat. No. 1,300,342, issued to D. R. Campbell on Apr. 15, 1919; U.S. Pat. No. 3,768,619, issued to R. A. Lewis on Oct. 30, 1973; U.S. Pat. No. 3,267,850, issued to J. W. Ryan, et al. on Aug. 23, 1966; and U.S. Pat. No. 3,834,507, issued to F. C. Bradshaw on Sept. 10, 1974. See also the machine disclosed in West German Pat. No. 2,357,509, issued to W. Schaible on Nov. 15, 1973.

One of the difficulties encountered using prior art die cutting machines is that they do not provide means for varying the spacing between different printed characters to provide appropriate, proportional spacing between combinations of different characters.

Another of the difficulties encountered using such prior art die cutting machines to heat the characters to be duplicated on plastic tape is that they do not provide thermal isolation between the printing characters used to die cut and heat the tape during printing operations and other thermally conductive metallic elements of the machine. As a consequence, it is often difficult to maintain the desired level of heat on the printing characters after repeated use thereof.

Still another difficulty that has been encountered using such prior art machines is that a number of separate and distinct manually manipulative steps is often required to complete a single print cycle for a given character to be printed in the tape, by reason of which the machines print each character at a relatively slow rate of speed.

By means of my invention, these and other difficulties often encountered using such prior art machines are substantially overcome.

SUMMARY OF THE INVENTION

It is an object of my invention to provide an improved machine for heating and die cutting a plastic tape to form letters, numerals and other characters and combinations thereof from the tape.

It is another object of my invention to provide a novel movable print pedestal for lifting a plastic tape extending thereover into and against a print character formed on the underside of a printing plate to thereby heat and die cut the tape to reproduce the print character therein.

It is yet another object of my invention to provide precise alignment and locking means for a rotatable print plate to precisely align and hold a print character formed on the printing plate in position relative to a plastic tape in which a duplicate of the print character is to be formed.

It is still another object of my invention to provide a machine for heating and die cutting a plastic tape to form letters, numerals and other characters and combinations thereof from the tape having means for varying the spacing between different printed characters to provide appropriate, proportional spacing between combinations of different printed characters.

It is also an object of my invention to provide a machine for heating and die cutting characters from a plastic tape which employs means for thermally isolating the printing characters from certain other thermally conductive elements of the machine.

It is an additional object of my invention to provide a machine for heating and die cutting a plastic tape which completes each individual character print cycle fully automatically without the necessity of intervention by the operator to perform a number of separate and distinct manually manipulative steps.

Briefly, in accordance with the present invention, I provide an improved machine for heating and die cutting a printing tape with raised characters to form a reproduction of the characters in the tape. Specifically, the improvements include a frame, a rotatable print plate disposed in the frame and defining a plurality of raised characters spaced in a circle on and around one broad surface thereof, and means attached to the print plate for heating the raised characters. The improvements also include a print pedestal attached to the frame and disposed opposite the broad surface of the print plate. A print pad is attached to the pedestal which is movable upon command against any desired one of the raised characters depending upon the rotational alignment of the print plate relative to the pad. A locking means is also provided which is attached to the frame and which is engagable with the print plate upon command for locking and maintaining any desired one of the raised characters in precise alignment opposite the pad during each heating and die cutting operation on the tape.

These and other objects, features and advantages of the present invention will become apparent to those skilled in the art from the following detailed description and attached drawings upon which, by way of example, only a preferred embdiment of my invention is illustrated.

BRIEF DESCRIPTION OF PREFERRED EMBODIMENT

Figure 1:
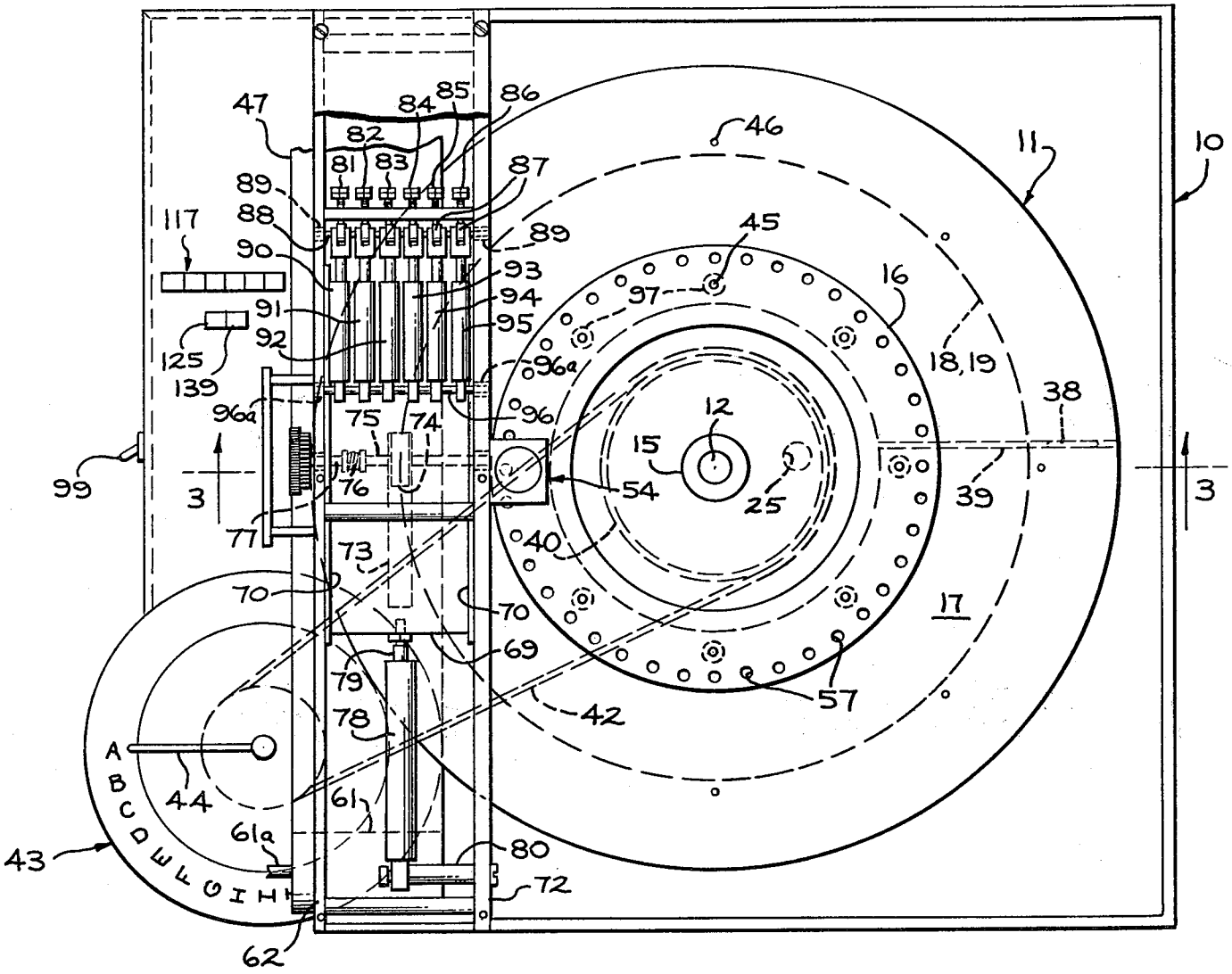
FIG. 1 shows a plan view of a thermal die cutting machine for die cutting letters, numerals and other characters from a band of plastic tape thus illustrating a preferred embodiment of the present invention.

Referring now to the drawings, particularly FIGS. 1–3 and 3*a*, there is shown in one preferred embodiment of my invention, a supporting frame or housing 10 in which is disposed a print disc or plate 11 rotatably mounted in an operable position on a vertically extending shaft 12. A base portion of the shaft 12 is fixedly held within a circular collar 13 (FIG. 3 only) which collar is, in turn, fixedly attached to a floor 14 of the housing 10. An upper portion of the shaft 12 projects above the upper surface of the collar 13 into and through a hollow cylindrical shaft formed in an elongated collar 15 which extends downward from a central disc-shaped hub 16 of the print plate 11. The lower end of the collar 15 may thus rest upon the upper surface of the collar 13 for slidable engagement therewith as the print plate 11 is turned.

In the alternative, a conventional thrust washer, not shown, may be placed over the shaft 12 and sandwiched between the upper surface of the collar 13 and the lower end of the collar 15 to reduce friction and wear between the collars as the print plate 11 is turned.

The print plate 11 includes, in addition to the hub 16 which is integrally formed on and around an upper end portion of the collar 16, a backing plate 17, a thin heating ring 18, and a magnesium alloy print ring 19 containing photographically etched raised letters, numerals and/or other characters 20 and around the periphery thereof. The backing plate 17 is formed from cast aluminum tooling material which is ground to form a very flat underside and which has a high degree of thermal stability or relatively low coefficient of thermal expansion. The plate 17 has the shape of an annulus with a relatively large central circular portion cutout to form a void 21. The heating ring 18 is conventional and consists of a zig-zag pattern of electrical resistance wire 22 sandwiched between two sheets of electrically insulative silicone rubber. The ring 18 is also in the form of a flat disc-shaped annulus whose horizontal width is about equal to the width of the underlying magnesium alloy print ring 19. The resistance wire 22 zig-zags through the silicone sheets in its travel around the periphery of the print plate 11 and terminates in a pair of leads 23 (FIG. 3 only) which project inwardly of the plate 11 away from the ring 18 immediately under the backing plate 17 where they are soldered to a pair of insulated lead wires 24*a*. The wires 24*a* extend from the leads 23 and ring 18 inwardly and along the underside of the plate 11, thence downwardly through a bore hole 25 in a disc-shaped gear collar 26 which is integrally formed on and around the collar 15 and, finally, downward through holes 27 and 28 (FIG. 3*a*) in an underlying disc-shaped sheet 29 of insulation to connections with two spaced and concentric rings forming closed, circular electrically conductive terminal strips 30, 31 mounted on the underside of the insulating sheet 29. Two other concentrically disposed ring-shaped electrically conductive terminal strips 32, 33 are mounted on the underside of the insulating sheet 29 and are electrically connected by means of two insulated lead wires 34*a*, 35*a*, respectively, which extend upwardly through holes 36, 37, respectively, in the insulating sheet 29, thence upwardly through the bore hole 25 in the collar 26 and radially outward along the underside of the hub 16 to connection with a conventional heat sensing element or temperature sensor 38 disposed over the heating ring 18 in a hollow shaft 39 drilled radially through the backing plate 17. The concentric terminal strips 30–33 may be formed of half hard brass or other suitable material.

The plate 11 with attachments including the gear collar 26, insulating sheet 29 and terminal strips 30–33 rotate in unison about the shaft 12 by means of a conventional circular gear belt 40 which extends around the side of the collar 26 in close fitting relation which contains spaced vertical ribs on the outer surface thereof, not shown, which mesh with identically pitched ribs 41 formed on the inside surface of an endless gear belt 42. The belt 42 thus extends from the collar 26 and surrounding belt 40 horizontally across the underside of the plate 11 to surround a manually rotatable character indexing wheel 43. The wheel 43 includes a stationary index marker 44 which enables the operator to determine which character 20 is aligned in proper position for being printed by the machine by aligning the same character with the marker 44 as marked on a peripheral edge portion of the upper surface of the wheel 43. In FIG. 1, the wheel 43 is shown with several alphabetic characters A, B, C and D marked around a portion of the periphery thereof for illustrative purposes with the wheel 43 being positioned so that the marker 44 points to the character A. Before mounting the belt 42 between the collar 26 and the wheel 43, the print plate 11 is rotated so that the corresponding character A on the bottom of the print ring 19 is aligned in the proper position for printing. Thereafter, the belt 42 is attached between the collar 26 and the wheel 43 so that the ribs or teeth 41 of the belt 42 intermesh with the ribs on the circular gear belt 40 surrounding the collar 26. The belt 40 may require a slight rotation around the collar 26 to obtain proper intermeshing of the ribs of the belts 40, 42 in order to achieve proper tracking between corresponding print characters on the print ring 19 and the wheel 43. Once the desired alignment is obtained as aforesaid, the circular belt 40 may be bolted securely on the collar 26 to prohibit slippage of the belt 40 on the collar by means of suitable fasteners as at 44*a* (FIG. 3).

Figures 3, 3A:
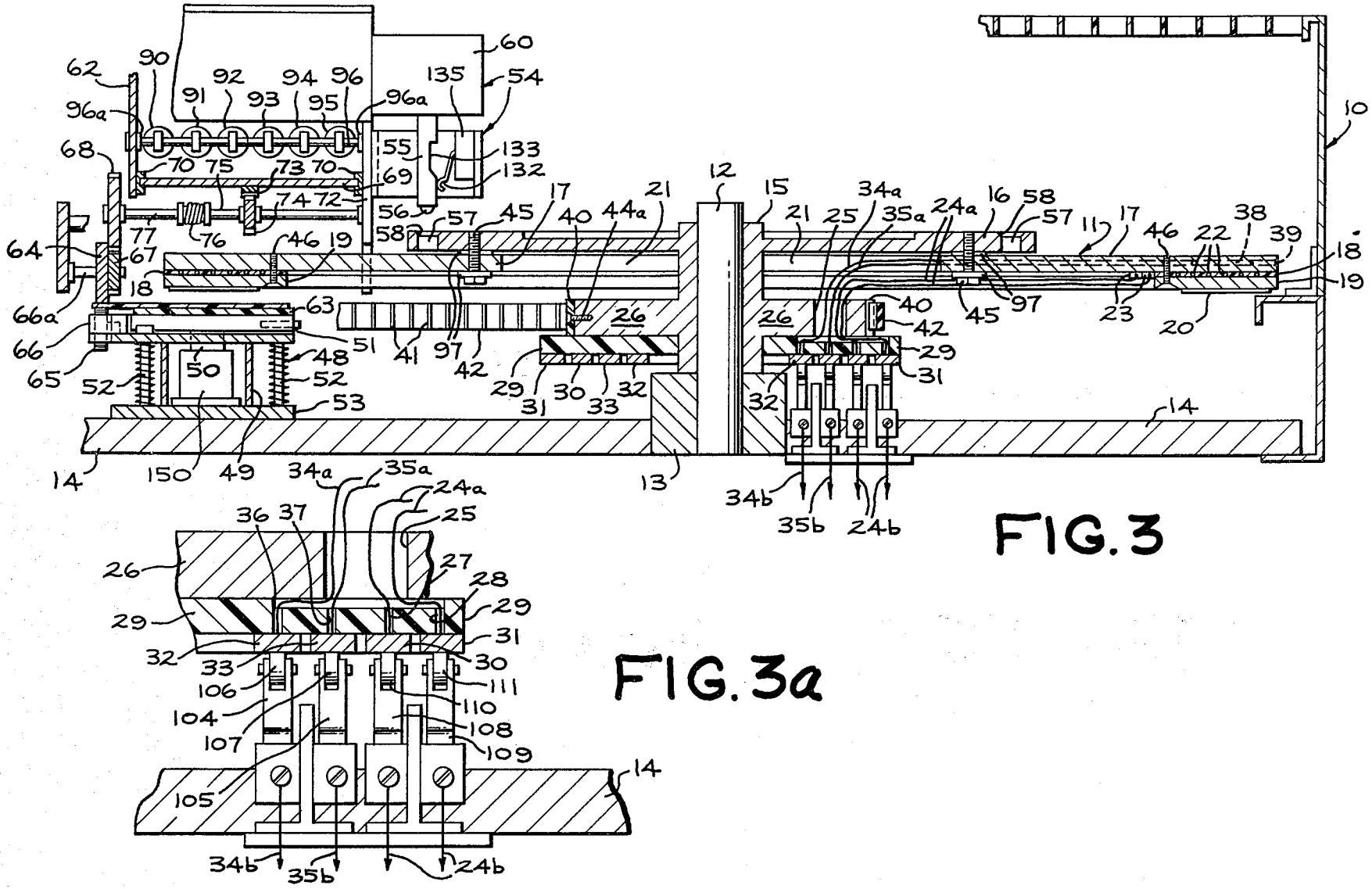
FIG. 3 shows a cross-sectional elevation view of the machine of FIG. 1 as viewed along cross-section lines 3—3 of the latter figure with certain parts being removed for clarity.
FIG. 3*a* is an enlarged view of a portion of the machine of FIG. 1, the same as viewed in FIG. 3 on a smaller scale.

The various components of the plate 11 are held together by means of suitable threaded fasteners 45 and 46 as shown in FIG. 3. Specifically, the fasteners 45 may be hex head bolts which are threaded upwardly from the underside of the plate 11 into and through a threaded hollow shaft bored through the backing plate 17 and the hub 16. The fasteners 46 may be flat head screws which are threaded into countersunk but unthreaded shafts drilled through the backing plate 17, an interior edge portion of the heat ring 18 beyond the interior most travel of the resistance wire 22 embedded therein, and the magnesium alloy print ring 19.

The character 20 to be printed by the machine is aligned directly over a band 47 of tape of suitable and conventional type used in thermal die cutting operations by manually turning the wheel 43 so that the desired corresponding character shown on the periphery of the wheel 43 appears in line with the index marker 44. In the aligned printing position, the character 20 to be printed is directly above a portion of the tape 47 which lies upon the upper surface of a printing pedestal 48. The pedestal 48 contains an air-operated cylinder in a housing 49 which includes a piston 50 which, upon command, lifts a plate 51 across which the tape 47 extends upwardly into and against the aligned character 20 positioned directly thereover. A series of three adjustable leveling screws 52 disposed in a triangular array and extending between a pedestal base 53 and the plate 51 are provided to permit precise alignment of the upper surface of the plate 51 parallel to the character 20 positioned thereover to assure even and uniform pressure on all portions of the character 20 against a print pad 63 during the printing operation.

To precisely align the desired character 20 for thermal cutting of the tape 47 over the pedestal 48, a locking assembly 54 is provided which includes a vertically movable plunger 55 having a rollable ball bearing 56 mounted in the lower end thereof which, when extended, is adapted to seat within one of a plurality of countersunk grooves 57 located in a circle on and around a peripheral edge portion of the hub 16, which is located approximately directly under the member 55. A sloping upper end portion 58 of the groove 57 allows the ball bearing 56 to roll, rather than slide, downward into the seat of the groove 57 located under the member 55 to prevent wear and abrasion of the portion 58 as the member 55 advances downwardly to lock the hub 16 in place for printing. At the same time that the member 55 advances to seat the bearing 56 in the desired groove 57, any slight misalignment between the groove 57 and member 55 is automatically corrected because the pressure of the bearing 56 along the sloping end portion 58 forces the hub 16 to turn on the shaft 12 the precise amount necessary to precisely seat the bearing 56. The number of grooves 57 is equal to the number of different characters 20 formed on the print ring 19 and each of the grooves 57 is aligned precisely between a different character 20 and the axis of the print plate 11. The member 55 is extended and retracted upon command by means of a double acting air-operated cylinder 59 (FIG. 6 only) located in a housing 60.

The free end of the tape 47 is drawn forwardly from a tape roll 61 rotatably mounted on an elongated pin **61*a* connected between a sidewall of the frame 10 and a compartment sidewall 62, thence across a hard rubber pad 63 attached to the upper surface of the pedestal leveling plate 51 and forwardly through a suitable opening in the front wall of the housing 10. As the tape 47 passes across the pad 63, an outer edge portion thereof passes between a driven roller 64 and a follower or idler roller 65. The idler roller 65 is rotatably connected to a bracket 66 depending from the pedestal leveling plate 51 while the driven roller 64 is rotatably connected by means of a projecting shaft 66*a* to a sidewall of the frame 10 in any suitable and convenient manner. The driven roller 64 has a gear 67 of smaller diameter than the roller 64 fixedly adjoined to one broad surface thereof which is intermeshed with a drive gear 68**.

The gear train 67, 68 is driven to advance the tape 47 across the pad 63 by a predetermined measured amount by means of a horizontally movable tape index plate 69 of flat, rectangular shape. The plate 69 is slidably mounted in a pair of elongated channels 70 located in opposing relation to one another and mounted on opposing surfaces of a compartment wall 72 and the wall 62. The plate 69 includes an elongated linear rack gear 73 fixedly attached to the underside thereof and aligned parallel to the direction of movement of the plate 69 along the channels 70. A pinion gear 74 intermeshes with the rack gear 73 on the underside of the plate 69 and is connected by means of a drive shaft 75 and conventional spring clutch 76 to a shaft 77 of the gear 68. The plate 69 is advanced and retracted along the channel 70, upon command, by means of a double acting air-operated cylinder 78 having a piston rod 79 connected to the rear end of the plate 69. The cylinder 78 is supported at the rear end thereof by a support member 80.

Figure 2:
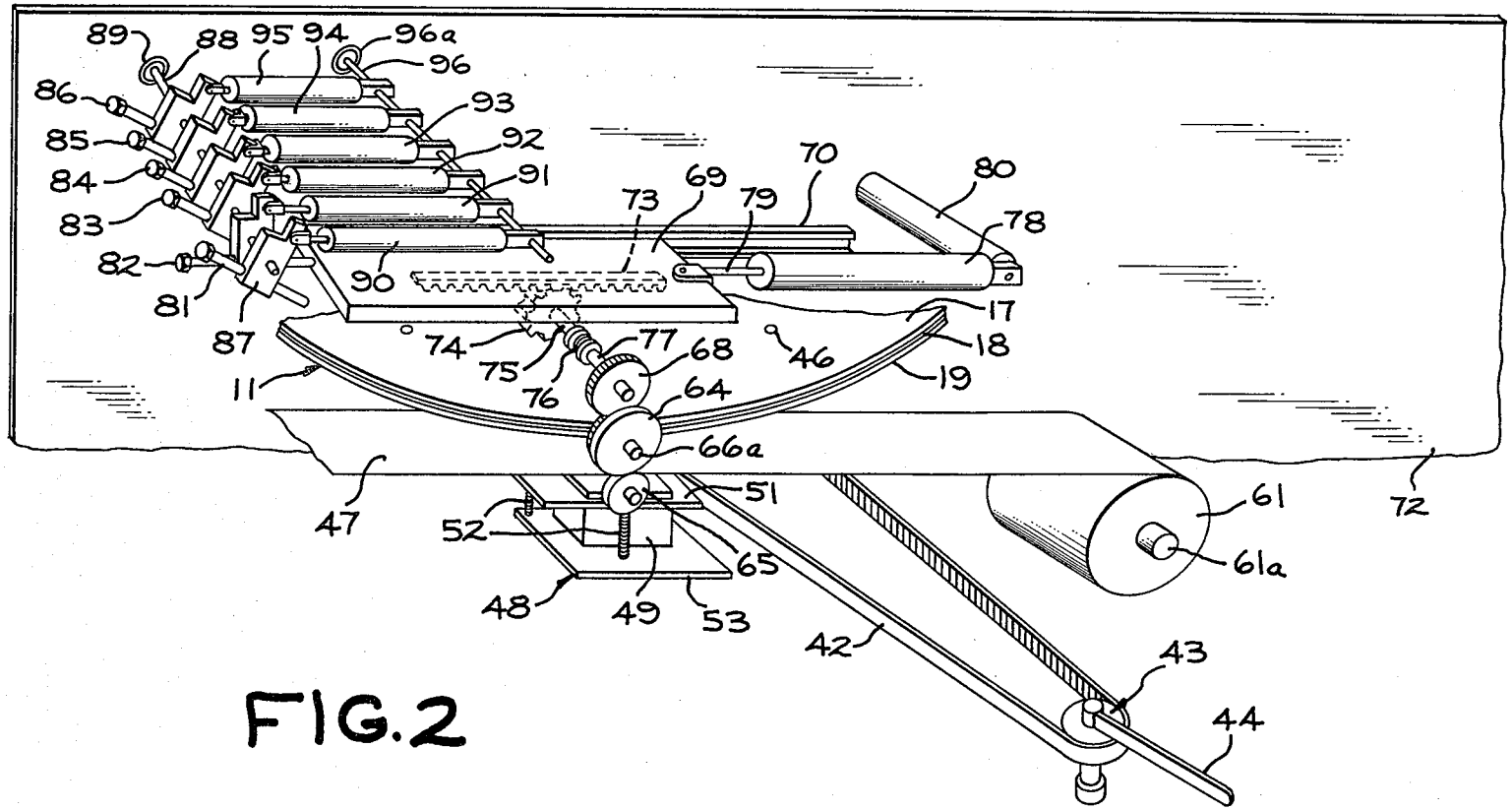
FIG. 2 shows an oblique projection of a fragmented portion of the machine of FIG. 1.

The plate 69 advances forwardly along the channels 70 toward a series of six adjustable stop pins 81–86 threaded through six support blocks 87 which are, in turn, pivotally mounted along an elongated pivot pin 88 connected between compartment walls 62, 72. The pivot pin 88 is constructed of any suitable rigid material which is also electrically conductive for reasons as will later be explained and is mounted in electrically insulative dielectric bushings 89 located in the walls 62, 72 to isolate the pin 88 from chassis ground. The upper ends of the blocks 81–86 are connected to the piston rods of six single acting, spring return, air-operated cylinders 90–95 such that when one of the piston rods is advanced, the block to which it is connected pivots in one direction about the pin 88 until its corresponding stop pin is aligned in interferring relation to the forward advancement of the plate 69. Conversely, as a given one of the piston rods of the cylinders 90–95 is retracted by its own internal spring biasing action, the block to which the rod is attached pivots in the opposite direction around the pin 88 to raise the corresponding stop pin upwardly out of interferring relation to the advancing plate 69. The total horizontal distance of travel of the plate 69 within the limits of the extension distance of the piston rod 79 is thus determined by which one of the pins 81–86 is pivoted into a horizontal, interferring relation with the plate 69 and the extent to which that pin is threaded through its corresponding block. The rearward ends of the cylinders 90–95 are connected to a supporting pin 96 which is connected on its opposite ends to the compartment walls 62, 72 and electrically insulated therefrom by dielectric bushing **96*a*. For reasons as later explained, only one of the cylinders 91–95 will be in an advanced position at any one time such that only one of the stop pins 81–86 will be positioned in horizontal interferring relation with the advancement of the plate 69 at any one time, and at that time, the remaining five subject cylinders will be retracted such that their corresponding five stop pins will be in a raised position out of interferring relation with the plate 69. In the present example, FIG. 2 shows only the cylinder 91 in an advanced position wherein its corresponding stop pin 82 is in a horizontal interferring relation with the plate 69 whereas the remaining cylinders 90 and 92–95 and their corresponding stop pins 81 and 83–86 are retracted. Each of the threaded stop pins 81–86 can be set to stop the advancement of the plate 69 at a different distance within the total length of extension of the piston rod 79** depending upon the setting of each pin in its corresponding block.

As the plate 69 is advanced by extension of the cylinder rod 79, the advancing rack gear 73 drives the pinion 74 which, in turn, rotates the shaft 75. Such rotation of the shaft 75 is transmitted through the tightening spring clutch 76 to cause rotation of the shaft 77 and gear 68 which, in turn, drives the gear 67 to turn the driven and idler rollers 64, 65 to thus advance the tape 47 forwardly in the direction of movement of the plate 69 until the forward end of the plate 69 engages the stop pin 82. Depending upon the setting of the stop pin 82, the tape 47 is thus advanced across the pad 63 the precise distance required for appropriate spacing of the selected character which it is desired to reproduce from the tape 47. The tape advance is thus proportional to the index plate advance.

The heating ring 18 is employed to heat the underlying magnesium alloy print ring 19 and characters 20 spaced therearound as the technique of thermal die cutting of conventional adhesive backed vinyl tapes such as the tape 47 requires the use of both pressure and heat in order to cut such a character out of the tape 47. However, it will be recognized that heat from the ring 18 will likewise be transmitted upwardly into the overlying aluminum backing plate 17. The relatively larger surface area and volume of the backing plate 17 can thus be used beneficially as a thermal or heat reservoir to help maintain the print ring 19 and characters 20 at a relatively constant temperature even after repeated and successive printing operations provided the backing plate 17 is effectively thermally isolated from the aluminum hub 16, collars 13, 15 and 26, the shaft 12 and the like. Without such effective thermal isolation, the heat transmitted to the backing plate 17 would not be stored therein but would be drained off to the aforementioned hub, collars and shaft which are, of course, relatively massive structures. While all of the aforementioned elements of the structure could eventually be brought to thermal equilibrium at the desired temperature without such effective isolation, the electrical power required to achieve such thermal equilibrium would be substantial and the time delay required would likewise be considerable.

To avoid such waste of power and time delay, I thermally isolate the hub 16 from the backing plate 17 by placing eight flat washers 97 formed of suitable thermal insulating material such as Teflon between the hub 16 and underlying edge portion of the plate 17 around the bolts 45 as well as eight additional insulating washers 97 between the heads of the bolts 45 and the backing plate 17. While the bolts 45 conduct some heat from the plate 17 to the hub 16, I find that such heat transfer is negligible and especially as compared to the heat transfer that would otherwise occur if the entire overlapping surface areas of the hub 16 and plate 17 were tightly bolted flush against one another without using the washers 97.

Figure 4:
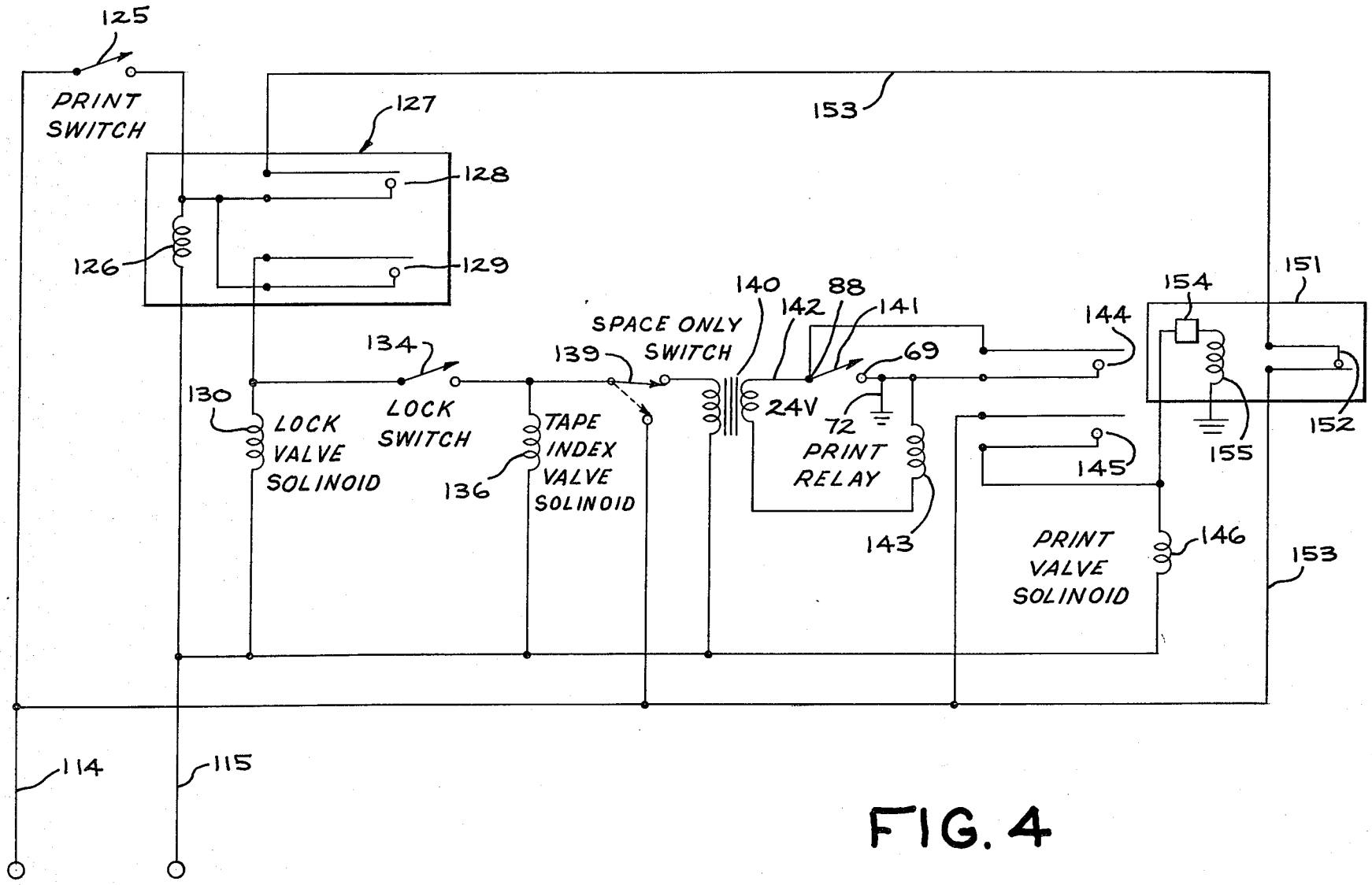
FIG. 4 shows a schematic diagram of an electrical circuit for the electrically operated valves and relays of the machine of FIG. 1.
Figure 5:
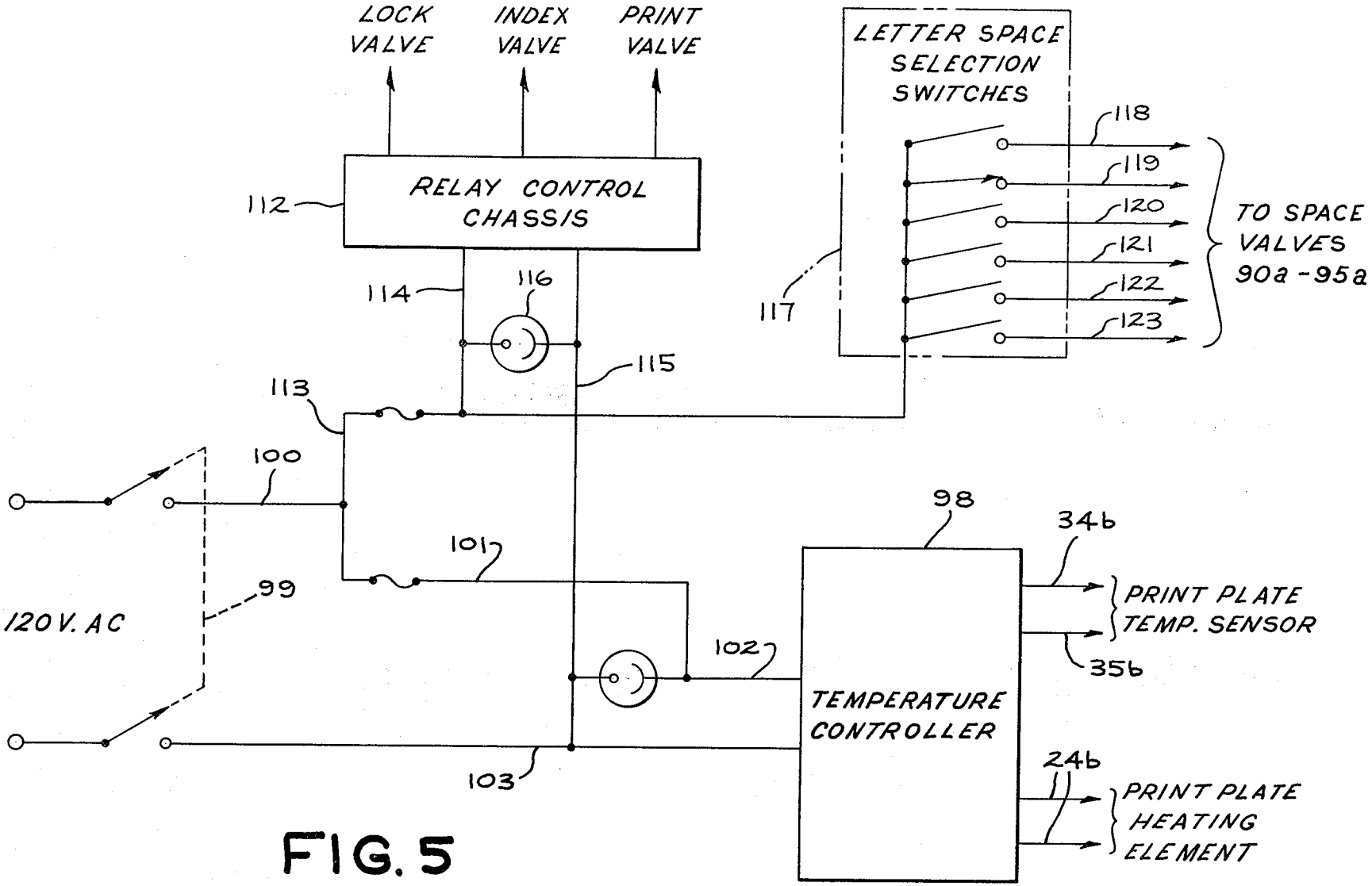
FIG. 5 shows a schematic diagram of a primary electrical power supply for the circuit of FIG. 4 as well as for certain other electrical components of the machine of FIG. 1.
Figure 6:
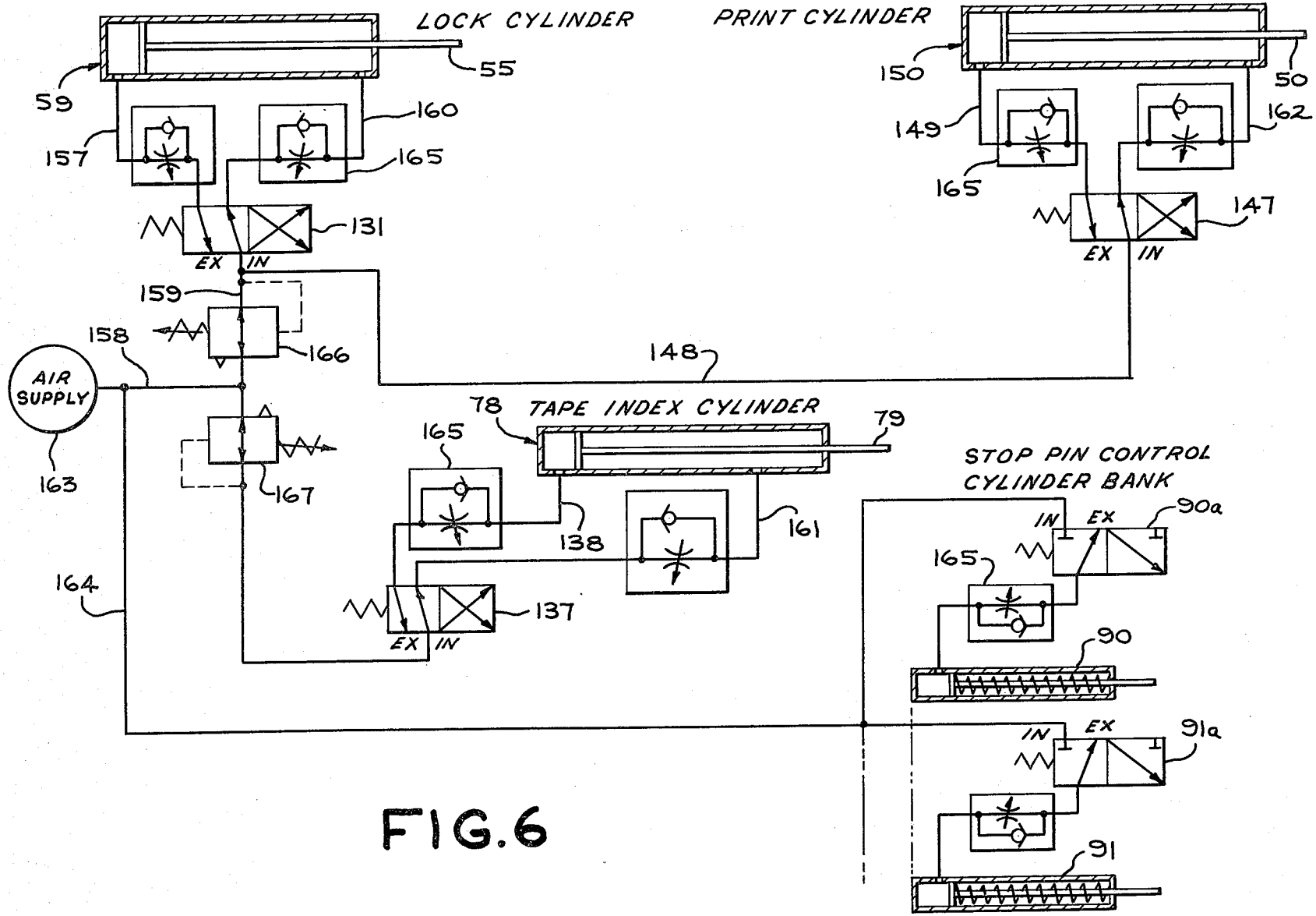
FIG. 6 shows a schematic diagram for a pneumatic circuit for controlling various air-operated cylinders in the machine of FIG. 1.

Referring now in addition to FIGS. 4–6, the electrical and pneumatic control systems and primary electrical power supply control circuit for the machine of the present example will now be explained. To supply and control electric power to the resistance wires 22 of the heat ring 18, I employ a conventional temperature controller 98 (FIG. 5 only) such as a Watlow Model 03-0086 as manufactured by Watlow Winona, Inc. of Winona, Mich. or the equivalent. The controller 98 utilizes conventional 120 vac commercial power supplied from a suitable source through a main power switch 99, one side of which is connected through a line 103 and the other side of which is connected through the lines 100–102. The heat sensing element 38 and its lead wires **34*a*, 35*a* are connected as previously mentioned to the circular terminal strips 32, 33, respectively. A pair of electrically conductive terminals 104 and 105 are respectively connected to the strips 32, 33 and maintain continuous contact therebetween as the plate 11 is turned by means of electrically conductive rollers 106, 107 which bear continuously upon the circular strips 32, 33 as the plate 11 and strips 32, 33 rotate as well as when the latter elements are stationary. The appropriate leads 34*b*, 35*b* from the temperature controller 98 are connected to screws on the terminals 104, 105 to complete the circuit. Similarly, 120 volt electric power to heat the resistance wires 22 of the heat ring 18 is supplied from the controller 98 through a pair of lead wires 24*b* to a pair of terminals 108, 109 which likewise include electrically conductive rollers 110, 111, respectively, which continuously bear upon the overlying ring-shaped terminal strips 30, 31, respectively. The terminals 104, 105 and 108, 109 are stationarily mounted on and secured to the floor 14**.

Control of the various air valves of the machine is accomplished by means of an electric control circuit as shown in FIG. 4 which operates as follows. The circuit of FIG. 4 is shown functionally in FIG. 5 as a block 112 and receives 120 vac primary control potential through the main switch 99, one side of which is supplied through lines 100, 113 and 114 and the other side of which is supplied through lines 103 and 115. A panel light 116 is connected between lines 114 and 116 to indicate the presence of power being supplied to the control circuit 112. Electrical control potential to operate a series of tape spacing valves **91*a*–95*a* is supplied from one side of the main switch 99 through the lines 100 and 113 to a 6-position letter or character space switch 117. The switch 117 is of standard 120 volt pushbutton type such as is commonly available wherein only one of six switch output lines 118–123 is connected to the input line 113 at a time. Depression of one of the pushbuttons will close one of the switch arms of the switch 117 to connect that switch arm's corresponding output line to the input line 113 and will simultaneously open any other of the switch arms that happened to be closed immediately prior to such depression. In the example of FIG. 5, the switch arm of switch 117 which connects the output line 119 to the input line 13 is shown as closed. The line 119 is thus the line which supplies power to a three-way valve 91*a* (FIG. 6) to supply air to the cylinder 91 to thus advance its piston and lower the pin 82 to the plate interferring position as shown in FIG. 2. Depression of any other one of the six pushbuttons 117 will likewise open the line 119 to cause the cylinder 91 to retract thus raising the pin 82 out of alignment with the forward end of the plate 69 and will at the same time supply power along one of the appropriate lines 118 or 112–123 to the corresponding air valve controlling one of the remaining cylinders 90 or 92–95 to lower another of the stop pins into interferring relation with the plate 69**.

Referring in addition to the control circuit 112 as shown in FIG. 4, there is shown a normally open, spring return, pushbutton print switch 125 connected in series with a coil 126 of a locking relay 127. When the print switch 125 is momentarily depressed to energize the coil 126, a pair of relay switch contacts 128, 129 close. Upon closure of switch arm 128, control potential is applied to the coil 126 through the switch 128 and a normally closed switch 152 of a time delay relay 151 to connect one side of the 120 volt source on the line 114 to relay 127 to hold the latter in an energized state. Accordingly, 120 vac is applied by the switch 129 across a coil 130 of a valve 131 which actuates the member 55 to extend downward (FIG. 3) to seat in one of the grooves 57 aligned approximately thereunder to thus precisely align the plate 11 for printing and for holding the plate 11 locked in the print position. As the member 55 advances downwardly, an arm 132 springs open into a recess or detent 133 of the member 55 thus closing a lock microswitch 134 (FIG. 4) located in the block 135 of FIG. 3. Upon closing of the microswitch 134, 120 vac is applied across a coil 136 of a solenoid which actuates the tape index valve 137 (FIG. 6) to apply air to the tape index cylinder 78 through an air line 138 to thus advance the piston rod 79 and plate 69 forwardly against the stop pin 82 (FIG. 2) which is assumed to be in the downward position as shown. The tape 47 has now been spaced the precisely desired distance across the pad 63 of pedestal 48 for printing of the desired character therein. At the same time, 120 vac is applied through the normally closed contacts of a SPDT spring return, space only switch 139, which is assumed for the moment to be in a closed position across a step-down transformer 140 to obtain a 24 volt output potential as shown in FIG. 4.

A switch 141 as shown in FIG. 4 is in actuality an open circuit between one side of the secondary of the transformer 140 which is connected by means of a lead wire 142 to the floating pivot pin 88 (FIGS. 1–2) which is insulated from chassis ground by the insulative bushings 89 and the tape index plate 69 which is at ground potential, being electrically connected through the index cylinder 78 and support member 80 to the compartment wall 72. The ground side of the switch 141 is designated in FIG. 4 by the same element number as the index plate 69 and its connection to chassis grond is designated by the same element number as to compartment wall 72. Thus, upon contact of the plate 69 with the stop pin 82, the floating side of the secondary of the transformer 140 is connected through the line 142 and pivot pin 88 to chassis ground through the plate 69, piston rod 79, cylinder 78, support member 80 and compartment wall 72. With the path indicated by the switch 141 thus closed, 24 vac is applied from the transformer 140 across a relay coil 143 of a print relay which thus closes relay contacts 144 and 145. Switch 144 thus acts to hold the coil 143 in an energized state even though the switch 141 thereafter opens momentarily due to retraction of the plate 69 away from the stop pin 82. At the same time, the switch 145 applies 120 vac potential across a print valve solenoid 146 to operate an air valve 147 (FIG. 6) to supply air through air lines 148, 149 to actuate a print cylinder 150 by advancing the plunger 50 and the plate 51, pad 63 and overlying tape 47 (FIGS. 2–3) upwardly against the overlying character 20 to thus print the character in the tape 47. Also at the same time, 120 vac potential is supplied through the closed switch 145 to a time delay relay 151 to initiate a timing sequence as preset in a time delay circuit 154 to maintain the switch 152 in its normally closed state until the timing sequence is complete. Thus so long as the switch 152 remains in its normally closed position prior to completion of the timing sequence, the print valve solenoid 146 remains energized to hold the pad 63 and tape 47 tightly under pressure against the character 20 for the desired length of time as preset in a time delay circuit 154 of the relay 151.

As a consequence, the pad 63 will maintain the tape 47 tightly against the character 20 for a sufficient time to allow the character 20 to print through a combination of pressure and heat applied to the tape 47 for the required period of time, say 0.5 seconds or so, until the timing circuit 154 of the relay 151 times out at which time the time delay relay coil 155 will be automatically de-energized. When this occurs, the switch 152 opens removing control potential from the line 153 and consequently the coil 126 of the main relay 127, the switches 128, 129 thus open and control potential is thereupon removed from across the lock valve solenoid 130. With control potential removed from the lock valve solenoid 130, the 4-way air valve 131 (FIG. 6) shifts position to remove air from a line 157 at one end of the lock cylinder 59 and to apply input air from air lines 158, 159 and 160 to the opposite end of the cylinder 59 to retract the member 55 upwardly out of the groove 57. As the member 55 retracts, the switch arm 132 returns to the depressed position as shown in FIG. 3 and the microswitch 134 opens to remove control potential from across the index valve solenoid 136. Upon deenergizing the solenoid 136, the 4-way air valve 137 shifts position to remove input air from the air line 138 and place air on a line 161 to thus cause the piston rod 79 of the index cylinder 78 to retract and thus retract the tape index plate 69 toward its rearward position away from contact with the stop pin 82. This, in turn, breaks the ground contact between the pivot pin 88 and the compartment wall 72 to remove the 24 volt potential from across the coil 143 of the print relay which causes the 4-way air valve 147 (FIG. 6) to shift position thus removing air from the air line 149 and instead placing air on the other end of the print cylinder 150 through an air line 162. The print cylinder piston rod 50, leveling plate 51 and pad 63 thus retract to the start position as shown in FIG. 3.

Referring now specifically to FIG. 6, there is shown an air supply 163 connected through a line 164 to various 3-way valves **90*a*–95*a* associated with each of the stop pin control cylinders 90–95, of which only two are shown for simplicity. Air to the cylinders 90–95 and 59, 78 and 150 passes through conventional flow control valves 165. A 60 psi regulator 166 regulates air flow from the line 158 to the lock and print cylinders 59 and 150 while a 40 psi regulator 167 is used to regulate air flow to the tape index cylinder 78. Air to the various stop control cylinders 90–95 flowing through the line 164** need not be regulated.

Occasionally it is desirable to advance the tape 47 by one of the six selectable distances across the pedestal 48 without executing a printing or die cutting operation. To accomplish this, the desired pushbutton is depressed on the switch 117 to set the desired one of the stop pins 81–86 in interferring relation with the index plate 69. Thereafter, the space only switch 139 is depressed to close the normally open contacts thereof to apply 120 volt operating potential from the lines 114, 115 across the coil 136 of the index valve solenoid to thus actuate the cylinder 78 and advance the plate 69 forwardly toward the selected one of the stop pins 81–86. At the same time, the tape 47 advances forwardly across the pedestal 48 by a distance proportional to the distance of advance of the plate 69. Since the switch 139 is depressed, no voltage is applied to the transformer 140 or consequently to the print relay 143, print valve solenoid 146 or the time delay relay 151, whereby the tape 47 advances but no printing operation occurs. Also, since the lock microswitch 134 is open, the lock valve solenoid is disabled and the plunger 55 remains in its retracted position.

Lastly, it will be noted that upon retraction of the tape index cylinder 78, the rack 173 moves in reverse to reverse the direction of rotation of the pinion 74. Under such circumstances, the shaft 75 turns in the same direction as the pinion 74 to unwind the spring clutch 76 and thus decouple the shaft 77 from the shaft 75, whereby the gear train 67, 68 is disabled and the tape 47 remains in a stationary position.

Although the subject invention has been described with respect to specific details of a certain preferred embodiment thereof, it is not intended that such details limit the scope of the present invention to be covered herein otherwise than as specifically set forth in the following claims.

I claim:

1. In an improved machine for heating and die cutting a printing tape with raised characters to form a reproduction of said characters in said tape, the improvements comprising a frame, a rotatable print plate disposed in said frame and defining a plurality of raised characters spaced in a circle on and around one broad surface thereof, said print plate comprising a central hub, a backing plate formed of a thermally conductive material attached to said hub, means for effectively isolating said backing plate from said hub thermally wherein said backing plate forms a heat reservoir, and a thermally conductive printing ring attached to said backing plate, said raised characters being attached to said printing ring, said heating means being disposed between said printing ring and backing plate, means attached to said print plate for heating said raised characters, print pedestal means attached to said frame and disposed opposite said broad surface and containing a print pad movable upon command against any desired one of said raised characters depending upon the rotational alignment of said print plate relative to said pad, means mounted in said frame for selectively advancing a printing tape across said pad by at least one predetermined distance between each successive heating and die cutting operation on said tape, and locking means attached to said frame and engagable with said print plate upon command for locking and maintaining any desired one of said raised characters in precise alignment opposite said pad during each heating and die cutting operation on said tape.

2. The improved machine of claim 1 further comprising means for actuating said advancing means to advance said tape across said pad by said distance, means for actuating said locking means to engage said print plate, means for actuating said print pedestal means after said tape has advanced across said pad by said predetermined distance to perform a heating and die cutting operation on said tape, and means for disengaging said locking means from said print plate after the completion of said heating and die cutting operation.

3. The improved machine of claim 1 wherein said print pedestal means comprises a leveling plate, said pad being constructed of a compressible, resilient material and being attached to said leveling plate, means for moving said leveling plate upon command to force said pad against said one of said characters, and means for adjusting the attitude of said leveling plate to cause all portions of said desired character to bear evenly into said tape.

4. The improved machine of claim 3 wherein said moving means comprises a double acting air cylinder.

5. The improved machine of claim 1 wherein said print plate is disc-shaped.

6. The improved machine of claim 1 wherein said locking means comprises a movable plunger, said print plate defining a series of grooves spaced on and around a circle in the other broad surface thereof, each of said grooves being formed on a radial line between the axis of rotation of said print plate and a different one of said raised characters, said grooves having tapered upper surface portions at and near their openings, said plunger containing a rollable ball bearing upon a free end thereof for rolling along the tapered surface portions into a seat in each of said grooves to precisely align any desired one of said raised characters opposite said tape and for maintaining such alignment during each successive heating and die cutting operation on said tape.

7. In an improved machine for heating and die cutting a printing tape with raised characters to form a reproduction of said characters in said tape, a rotatable print plate comprising a central hub, a backing plate formed of a thermally conductive material attached to said hub, means for effectively isolating said backing plate from said hub thermally wherein said backing plate forms a heat reservoir, and a thermally conductive printing ring attached to said backing plate and defining a plurality of raised characters disposed in a circle around one broad surface of said printing ring, and means for heating said raised characters disposed between said backing plate and printing ring.

8. The improved machine of claim 7 further comprising temperature sensing means disposed in a hollow shaft in said backing plate opposite said heating means.

9. The improved machine of claim 7 wherein said isolating means comprises thermal insulating material disposed between said hub and backing plate to space said hub and backing plate apart.

10. The improved machine of claim 8 further comprising a temperature controller responsively connected to said temperature sensing means and operatively connected to said heating means.

11. The improved machine of claim 9 wherein said thermal insulating material comprises a series of flat washers disposed in a circular array around said print plate.

12. In an improved machine for heating and die cutting a printing tape with raised characters to form a reproduction of said characters in said tape, the improvements comprising a frame, a rotatable printing plate disposed in said frame defining a plurality of raised characters spaced in a circle on and around one broad surface thereof, print pedestal means attached to said frame and disposed opposite said broad surface and containing a print pad movable upon command against any desired one of said raised characters depending upon the rotational alignment of said print plate relative to said pad, means for selectively advancing a printing tape across said pad by at least one predetermined distance comprising a tape index plate movably attached to said frame for advancing and retracting upon command, gear train means responsively connected to said plate for rotatable operation in response to the advancement of said tape index plate, tape roller means responsively connected to said gear train means for advancing said tape across said pad in response to the advancement of said tape index plate, and stop means aligned in interferring relation with said tape index plate for limiting the advancement of said tape index plate to a precise distance, the distance of advance of said tape across said pad being proportional to said precise distance.

13. The improved machine of claim 12 wherein said stop means comprises a plurality of adjustable stop pins pivotally attached to said frame, each of said stop pins being separately pivotal into interferring relation with the advancing movement of said tape index plate, and a tape index double acting air cylinder connected to said tape index plate to advance said tape index plate upon command against a selected one of said stop pins.

14. The improved machine of claim 12 further comprising a clutch connected in said gear train means for coupling said tape index plate to said tape roller means while said tape index plate advances and for de-coupling said tape index plate from said tape roller means while said tape index plate retracts.

15. The improved machine of claim 12 further comprising time delay means for holding said pad against said desired one of said characters for a predetermined period of time during a heating die cutting operation on said tape.

16. In an improved machine for heating and die cutting a printing tape with raised characters to form a reproduction of said characters in said tape, the improvements comprising a frame, a rotatable print plate disposed in said frame and defining a plurality of raised characters spaced in a circle on and around one broad surface thereof, means attached to said print plate for heating said raised characters, print pedestal means attached to said frame and disposed opposite said broad surface and containing a print pad movable upon command against any desired one of said raised characters depending upon the rotational alignment of said print plate relative to said pad, means mounted in said frame for selectively advancing a printing tape across said pad by at least one predetermined distance between each successive heating and die cutting operation on said tape, said advancing means comprising a tape index plate movably attached to said frame, gear train means responsively connected to said plate for rotational operation in response to the movement of said tape index plate in one direction, tape roller means responsively connected to said gear train means for advancing said tape across said pad in response to the movement of said tape index plate in said one direction, means for advancing and retracting said tape index plate relative to said frame upon command, and stop means aligned in interferring relation with said tape index plate for limiting the advancement of said tape index plate to a precise distance, the distance of advance of said tape across said pad being proportional to said precise distance, and locking means attached to said frame and engagable with said print plate upon command for locking and maintaining any desired one of said raised characters in precise alignment opposite said pad during each heating and die cutting operation on said tape.

* * * * *